US005160253A

United States Patent [19]

Okada et al.

[11] Patent Number: 5,160,253

[45] Date of Patent: Nov. 3, 1992

[54] SCROLL TYPE FLUID APPARATUS HAVING SEALING MEMBER IN RECESS FORMING SUCTION SPACE

[75] Inventors: Hiroki Okada; Hiroshi Mitsuhashi; Susumu Sakamoto, all of Kanagawa, Japan

[73] Assignee: Tokico Ltd., Kanagawa, Japan

[21] Appl. No.: 731,312

[22] Filed: Jul. 17, 1991

[30] Foreign Application Priority Data

Jul. 20, 1990 [JP] Japan ..... 2-192539

[51] Int. Cl.[5] ..... F01C 1/04; F01C 19/00; F01C 21/04

[52] U.S. Cl. ..... 418/55.2; 418/55.4; 418/55.6; 418/143

[58] Field of Search ..... 418/55.1, 55.2, 55.4, 418/143, 55.6

[56] References Cited

U.S. PATENT DOCUMENTS

| | | | |
|---|---|---|---|
| 4,129,405 | 12/1978 | McCullough | 418/55.2 |
| 4,300,875 | 11/1981 | Fischer et al. | 418/55.2 |
| 4,673,340 | 6/1987 | Mabe et al. | 418/55.1 |
| 5,051,079 | 9/1991 | Richardson, Jr. | 418/55.2 |
| 5,069,605 | 12/1991 | Saitoh et al. | 418/55.2 |

FOREIGN PATENT DOCUMENTS

| | | | |
|---|---|---|---|
| 63-88292 | 4/1988 | Japan | 418/55.2 |
| 63-173883 | 7/1988 | Japan | 418/55.1 |

*Primary Examiner*—John J. Vrablik
*Attorney, Agent, or Firm*—Wenderoth, Lind & Ponack

[57] ABSTRACT

A scroll type fluid apparatus includes a casing having a flange member defining an annular recess therein, a drive shaft journalled on the casing and having a crank shaft formed at an inner end of the drive shaft extending in the casing, an orbiting scroll member rotatably mounted on the crank shaft and having a mirror-finished plate and a scroll wrap extending upright on the plate, a stationary scroll member mounted on the casing and including a mirror-finished plate having scroll wrap extending upright thereon and engaged with the scroll wrap of the orbiting scroll member, a suction port communicating with the interior of the annular recess of the annular flange member, a discharge port, and a sealing member disposed in the annular recess of the annular flange member for sealing a compression chamber within the annular recess from the interior of a body of the casing. The annular flange member and the mirror-finished plate are formed as separate parts in advance and are then secured to each other to constitute the stationary scroll member.

4 Claims, 1 Drawing Sheet

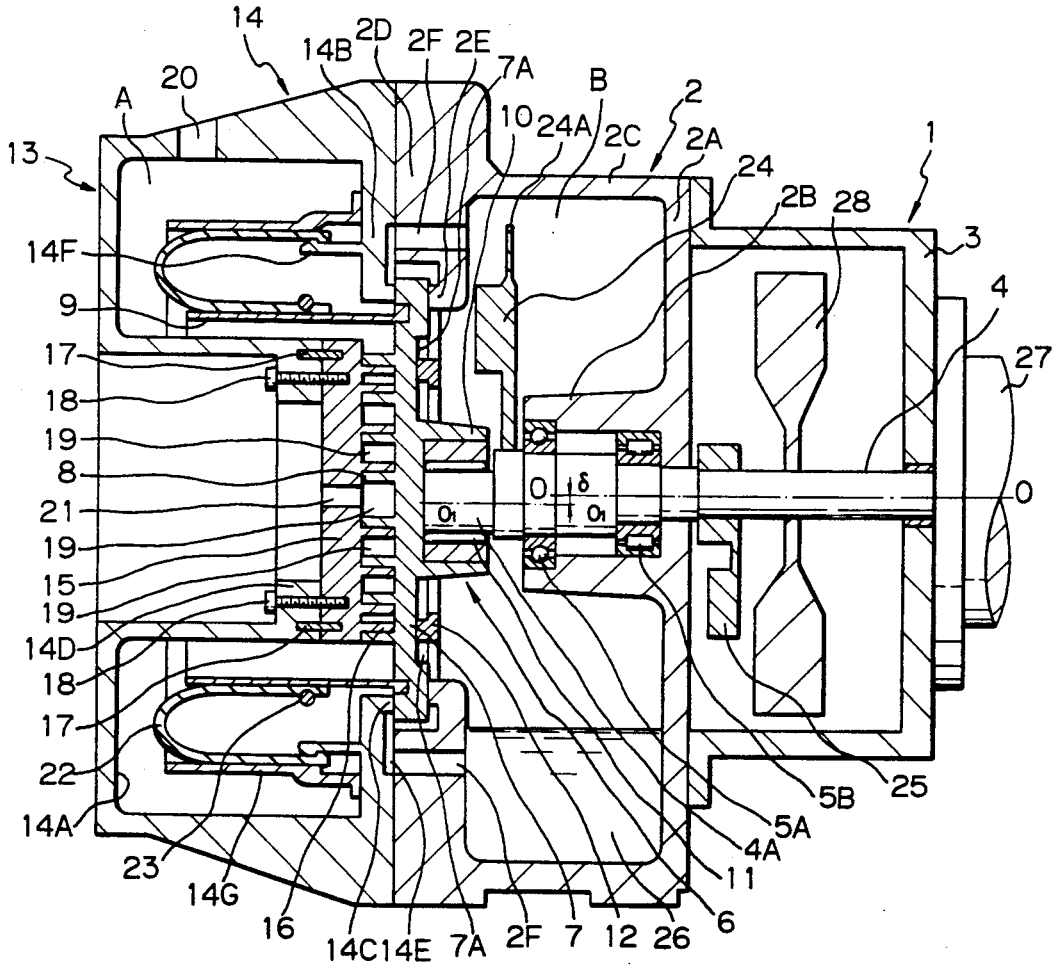
14
14B
2D
2F
2E
7A
20
A
B
2
10
24A
2C
2A
1
13
24
2B
28
3
14F
4
9
27
17
18
19
8
O
δ
O
21
O1
O1
19
15
19
14D
18
17
22
14A
23
14G
16
14C
14E
7A
2F
7
12
26
6
11
4A
5A
5B
25

SCROLL TYPE FLUID APPARATUS HAVING SEALING MEMBER IN RECESS FORMING SUCTION SPACE

BACKGROUND OF THE INVENTION

1. Field of the Invention

The present invention relates to a scroll type fluid apparatus adapted for use in fluid machines such as, for example, air compressors, vacuum pumps and so on. The invention particularly relates to a semi-lubricated scroll-type fluid apparatus in which a lubricant is not supplied between the scroll wrap of the orbiting scroll member and the scroll wrap of the stationary scroll member.

2. Prior Art

Generally, a semi-lubricated scroll-type fluid apparatus comprises a casing, a drive shaft journalled on the casing and provided with a crank shaft portion formed at the inner end thereof which is located within the casing, an orbiting scroll member rotatably journalled on the crank shaft portion of the drive shaft through a bearing and including a mirror-finished plate and an orbiting scroll wrap extending upright on the plate, a stationary scroll member mounted on the casing and including an annular flange having an annular recess therein, a mirror-finished plate, and a stationary scroll wrap extending upright on the plate and formed so as to cooperate with the orbiting scroll wrap to define a sealed space therebetween, a suction port for fluid formed through the casing or through the annular flange of the stationary scroll member, the suction port communicating with the annular recess of the annular flange, a discharge port for fluid formed through the mirror-finished plate of the stationary scroll member, and a sealing member disposed in the annular space of the annular flange of the stationary scroll member for sealing the space in the recess communicating with the suction port from the interior of the casing.

When the scroll type fluid apparatus mentioned above functions as an air compressor, the drive shaft is driven by means of a motor located outside the housing so as to drive the orbiting scroll member. Air sucked through the suction port is compressed in the sealed space or compression chamber defined between the stationary and orbiting scroll wraps, and then the compressed air is discharged through the discharge port into an air tank located outside.

In the conventional scroll type fluid machine mentioned above, lubricant, which is received within the casing and is adapted to be spread over the orbiting scroll member and bearings to lubricate and/or cool them, is reliably prevented from leaking out to the suction port side, since the sealing member is disposed in the annular recess of the annular flange to seal the space communicating with the suction port from the interior of the casing.

However, the conventional scroll type fluid machine mentioned above suffers from the following disadvantages.

First, the stationary scroll member tends to be large in order to accommodate the sealing member.

Second, the fact that the annular flange and the mirror-finished plate of the stationary scroll member are formed integrally with each other results in a difficult manufacturing process which leads not only to an increase in manufacturing costs but also to a debasement in accuracy of the stationary scroll wrap, thereby substantially lowering the compression efficiency, reliability and durability of the machine.

SUMMARY OF THE INVENTION

The present invention has been made in view of the foregoing problems in the conventional scroll type fluid apparatus, and it is therefore an object of the present invention to provide a scroll type fluid apparatus in which difficult manufacturing processes are not necessary in forming a scroll wrap on the mirror-finished plate of a stationary scroll member and in which the accuracy of the scroll wrap is improved.

To achieve the above object, the present invention provides a scroll type fluid apparatus comprising a casing including an annular flange member defining an annular recess therein; a drive shaft journalled on the casing and provided at its inner end extending within the casing with a crank shaft; an orbiting scroll member rotatably mounted on the crank shaft through a bearing, the orbiting scroll member including a mirror-finished plate and an orbiting scroll wrap extending upright on the mirror-finished plate; a stationary scroll member mounted on the casing and including a mirror-finished plate and a stationary scroll wrap extending upright on the mirror-finished plate, the stationary scroll wrap being formed so as to cooperate with the orbiting scroll wrap to define a sealed space therebetween; a suction port for fluid communicating with the interior of the recess; a discharge port for fluid formed through the mirror-finished plate of the stationary scroll member; and a sealing member disposed in the annular recess of the annular flange member for defining a space in the recess communicating with the suction port and for sealing the space from the interior of the casing. The annular flange member and the mirror-finished plate of the stationary scroll member are formed as separate elements and are secured to each other with a securing means.

Other objects and features of the present invention will become apparent from the following description of a preferred embodiment made with reference to the accompanying drawing.

BRIEF DESCRIPTION OF THE DRAWING

FIG. 1 is a sectional view of an embodiment of a scroll-type air compressor according to the invention.

DETAILED DESCRIPTION OF THE PREFERRED EMBODIMENT

Referring to the drawing, a preferred embodiment of the invention will be explained in detail as applied to a scroll type air compressor.

Shown at 1 is a casing which consists of a casing body 2 having the shape of a close-ended cylinder and a rear casing member 3 mounted on the closed end of the casing body 2. The casing body 2 is provided with a disk-like bottom portion 2A, a shaft receiving portion 2B extending inwardly of the casing body 2 and centrally from the bottom portion 2A, a tubular portion 2C extending from the outer circumference of the bottom portion 2A toward a stationary scroll member 13 which will be described hereinafter, and a flange portion 2D extending radially inwardly at the end of the tubular portion 2C. The casing body is further provided with a bearing portion 2E formed on the inner circumferential portion of the flange portion 2D and adapted to bear a thrust force from an orbiting scroll member 6 which will be described hereinafter. The flange portion 2D is provided with a plurality of passages 2F (only two are shown in the figure) formed therethrough and spaced apart from each other in the circumferential direction of the flange portion.

The rear casing member 3 is also in the shape of a close-ended cylinder and is mounted on the casing body 2 with the open end thereof abutting against the bottom portion 2A of the casing body 2. The rear casing member 3 is provided with a passage for air (not shown) formed through the cylindrical wall thereof.

A drive shaft 4 is journalled for rotation about an axis 0—0 in the shaft receiving portion 2B of the casing body 2 by means of bearings 5A and 5B. The drive shaft 4 extends into the casing body 2 and is provided with a crank shaft 4A formed on the inner end thereof. The axis $0_1$—$0_1$ of the crank shaft 4A is offset from the axis 0—0 by an eccentricity δ. The other or outer end of the drive shaft extends to the outside of the rear casing member 3 and is connected to a motor 27 for driving the drive shaft 4.

The orbiting scroll member 6 is rotatably mounted on the crank shaft 4A. The orbiting scroll member 6 is also provided with a disc-like mirror-finished plate 7 and a scroll wrap 8 extending upright on the front surface (left side surface as viewed in the figure) of the mirror-finished plate 7. The scroll wrap 8 also extends spirally from its inner end to its outer end. The orbiting scroll member 6 is also provided with a tubular portion 9 extending upright from the front surface of the plate 7 and spaced radially outwardly from the scroll wrap 8. The tubular portion 9 extends axially beyond the scroll wrap 8. The orbiting scroll member is further provided with a boss 10 centrally formed on the rear surface of the mirror-finished plate 7 for receiving therethrough the crank shaft 4A through a bearing 11. The mirror-finished plate is provided with a plurality of keyways 7A (only two are shown in the figure) formed in the rear surface thereof adjacent the outer circumference thereof and circumferentially spaced apart from each other. Each keyway 7A receives therein an associated Oldham coupling 12 which is well known as a rotation restricting mechanism. When the drive shaft 4 is rotated, the orbiting scroll member 6 is allowed to orbit around the axis 0—0 of the drive shaft 4 with a revolutional radius of "67 " but is prohibited from rotating around its own axis $0_1$—$0_1$ by means of the Oldham coupling 12.

Shown at 13 is a stationary scroll member abutting against the casing body 2 to close the open end of the casing body 2. The stationary scroll member 13 comprises an annular flange member 14 constituting part of the casing 1 and a mirror-finished plate 15 which are manufactured as separate elements as opposed to the conventional scroll type fluid apparatus described hereinbefore.

The flange member 14 is generally tubular and is located along the outer circumference of the stationary scroll member 13. The flange member 14 is provided with inner and outer side walls and a bottom wall which together form an annular recess 14A in which a sealing member 22 is disposed as explained hereinafter. The flange member 14 is further provided with a flange portion 14B extending radially inwardly at the tip end of the outer wall of the annular flange member and abutting against the flange portion 2D of the casing body 2, a bearing portion 14C formed on the inner circumferential portion of the flange portion 14B and slidably abutting against the front surface of the mirror-finished plate 7 of the orbiting scroll member 6 to bear a thrust force from the orbiting scroll member 6, and a mounting portion 14D extending radially inwardly from the tip end of the inner wall of the annular flange member. The mirror-finished plate 15 is fixed to the mounting portion 14D. The flange portion 14B is provided with an annular recess 14E formed in the outer surface thereof and communicating with the passages 2F of the casing body 2. The annular flange member 14 is further provided on the inner surface of the flange portion 14B with a tubular retaining portion 14F extending into the annular recess 14A and with a tubular extending portion 14G located radially outwardly of the retaining portion 14F and adapted to cooperate with the retaining portion 14F to clamp one end of an outer flap of the sealing member 22 therebetween.

The mirror-finished plate 15 is provided on its inner side surface with a scroll wrap 16 formed in the same manner as the scroll wrap 8 of the orbiting scroll member 6. When the plate 15 and the annular flange member 14 are assembled with each other, both members are first positioned by means of positioning pins 17 and are then fixed to each other by means of mounting bolts 18 to constitute the stationary scroll member 13. It should be noted that the mounting portion 14D of the annular flange member 14 is located along the outer circumferential portion of the mirror-finished plate 15 so that generally most of the outer surface of the plate 15 is exposed to the ambient air which is advantageous for cooling the plate 15. The scroll wrap 16 of the mirror-finished plate 15 is engaged with the scroll wrap 8 of the orbiting scroll member 6 with a predetermined phase difference so as to define a plurality of sealed compression chambers 19 which continue to reduce in volume as the orbiting scroll member undergoes orbiting motion.

Shown at 20 is a suction port formed through the outer side wall of the annular flange member 14 and adapted to communicate with the outermost compression chamber 19 through a space within the annular recess 14A. Reference numeral 21 is a discharge port formed through the mirror-finished plate 15 of the stationary scroll member 13. The discharge port 21 is located at the center of the plate so as to communicate with the innermost compression chamber 19.

The sealing member 22 is disposed in the annular recess 14A of the annular flange member 14 with the inner and outer ends thereof being sealingly secured to the tubular portion 9 of the orbiting scroll member 6 and the extending portion 14G of the annular flange member 14, respectively. Reference numeral 23 designates a retaining ring connecting the inner flap of sealing member 22 to the tubular portion. The sealing member is made of a flexible material suitable for packing and has a "U" shape in section. The sealing member 22 defines, in the annular flange member, a suction chamber A communicating with the suction port 20. The sealing member 22 reliably shuts off the fluid communication of the suction chamber A with a chamber B in the casing 1 through the annular recess 14E of the annular flange member 14 and the passages 2F of the casing body 2.

Counterweights 24 and 25 are fixedly mounted on the drive shaft 4 in the casing to maintain a rotational balance of the drive shaft 4 when it rotates. The counterweight 24 is provided on the tip thereof with a blade 24A for scooping up oil such as lubricant 26 received in the casing 1.

A fan 28 is fixedly mounted on the drive shaft 4 in the rear casing member 3. The fan 28 rotates in common with the drive shaft 4 to cool the bottom portion 2A of the casing body 2.

The operation of the scroll type air compressor will be explained hereinafter.

When the drive shaft 4 is rotated by the motor 27, the rotational movement is transmitted through the bearing 11 to the orbiting scroll member 6 to cause it to orbit around the axis 0—0 of the drive shaft 4 with a rotational radius of "δ". Each compression chamber 19 defined between the scroll wraps of the stationary and revolving scroll members gradually reduces in volume as the orbiting scroll member 6 orbits to compress the air sucked into the compression chambers through the discharge port 21 to an air tank (not shown) located outside. During operation, the blade 24A of the counterweight 24 scoops up oil received in the casing 1 and supplies it between the orbiting scroll member 6 and each of the bearing portions 2E and 14C through the passages 2F and the annular recess 14E as well as to the orbiting scroll member 6, the bearing 11 on the crank 4A and the bearings 5A and 5B to lubricate and cool those parts. The fan blows air flowing into the rear casing member 3 from the outside through the passage for air onto the bottom portion 2A of the casing body 2 to cool it.

In the embodiment described above, the mounting bolts 18 are employed to secure the annular flange member 14 and the mirror-finished plate 15 to each other. However, other means, for example welding, gluing and so on may be employed to secure the plate 15 to the annular flange member 14.

Although the sealing member 22 has a "U" shape in section in the embodiment described above, the sealing member 22 may have other shapes such as, for example, the shape of a bellows.

The suction port 20 may be formed through the flange portion 2D of the casing body 2 so as to communicate with the suction chamber A instead of being formed through the outer wall of the annular flange member 14 of the stationary scroll member 13 as in the embodiment described above.

Although the invention has been described with reference to a scroll type air compressor, the invention is not limited thereto. For example, the scroll type fluid apparatus of the invention may be embodied as a vacuum pump in which the scroll type fluid apparatus of the invention is connected to a vacuum container to generate a vacuum.

According to the present invention, the annular flange member and the mirror-finished plate of the stationary scroll member are made as separate members in advance and are then secured to each other by suitable securing means. This process allows for a selection of materials which are different and respectively most suitable for the two members. Further, making the two members separate in advance eliminates the difficulty in forming the stationary scroll wrap on the mirror-finished plate of the stationary scroll member and results in an increase in the accuracy of the stationary scroll wrap, thereby substantially improving the compression efficiency, reliability and durability of the apparatus. Further, when, for example, various kinds of air compressors having different specifications are required, the same annular flange member may be employed with all or several kinds of the air compressors. This leads to a reduction in the total number of parts which should be prepared and stored in advance for producing various kinds of air compressors, thereby resulting in a reduction in the manufacturing costs.

What is claimed is:

1. A scroll-type fluid apparatus comprising:

a casing including a casing body and an annular flange member, said annular flange member comprising an outer generally cylindrical wall, an inner generally cylindrical wall, a bottom plate connecting respective end portions of said outer and said inner cylindrical walls to define an annular recess therewith, a first flange extending radially inwardly from the other end portion of the outer cylindrical wall, and a second flange extending radially inwardly from the other end portion of said inner cylindrical wall, and said casing defining a suction port therein in communication with said annular recess;

a drive shaft rotatably supported in a journal of the casing and having a shaft portion extending through said casing body, said shaft portion including a crank;

an orbiting scroll member rotatably mounted on the crank through a bearing and including a mirror-finished plate and an orbiting scroll wrap which extends upright on the mirror-finished plate, said mirror-finished plate being slidably supported between said casing body and said first flange;

a sealing member including an outer flap and an inner flap and having a generally U-shaped cross section, said outer flap being connected to said first flange and said inner flap being connected to said mirror-finished plate of the orbiting scroll member, said sealing member defining a suction chamber in said annular space which communicates with said suction port, and said sealing member sealing said suction chamber from the interior of said casing body in a fluid-tight manner;

a mirror-finished plate and a stationary scroll wrap extending upright thereon which are together discrete from said annular flange member and are securely mounted on said second flange so as to constitute a stationary scroll member with said annular flange member, said stationary scroll wrap engaged with the scroll wrap of said orbiting scroll member so as to define a sealed space therebetween, the mirror-finished plate of said stationary scroll member defining a discharge port therethrough communicating with said sealed space, and said second flange supporting said mirror-finished plate of the stationary scroll member only at the peripheral portion of said plate to define an opening at which a portion of said mirror-finished plate of the stationary scroll member is exposed to ambient air; and means for supplying lubricant to where the mirror-finished plate of said orbiting scroll member is slidably supported between said casing body and said first flange.

2. A scroll-type fluid apparatus according to claim 1, wherein bolts securely mount said mirror-finished plate of the stationary scroll member to said second flange, and further comprising positioning means for registering the mirror-finished plate of said stationary scroll member in position relative to said second flange.

3. A scroll-type fluid apparatus according to claim 2, wherein said positioning means includes a pin having opposite ends received in respective holes formed in the second flange and the mirror-finished plate of said stationary scroll member.

4. A scroll-type fluid apparatus according to claim 1, and further comprising a tubular member fixed to the mirror-finished plate of said orbiting scroll member, said inner flap of the sealing member being connected to said tubular member.

* * * * *